US005343924A

United States Patent [19]

Hoffman

[11] Patent Number: 5,343,924

[45] Date of Patent: Sep. 6, 1994

[54] SYSTEM FOR MAINTAINING ALIGNMENT OF ROLL-UP BLIND SLATS

[76] Inventor: Robert E. Hoffman, 5618 Riviera Dr., Coral Gables, Fla. 33146

[21] Appl. No.: 158,017

[22] Filed: Nov. 24, 1993

Related U.S. Application Data

[63] Continuation of Ser. No. 922,868, Jul. 31, 1992, abandoned.

[51] Int. Cl.[5] ..... E06B 9/16

[52] U.S. Cl. ..... 160/235; 160/236

[58] Field of Search ..... 160/133, 236, 232, 235, 160/32, 33

[56] References Cited

U.S. PATENT DOCUMENTS

| | | | |
|---|---|---|---|
| 1,790,028 | 1/1931 | Stevenson | 160/232 |
| 2,569,621 | 10/1951 | Toney | 160/235 |
| 2,572,257 | 10/1951 | Gerner et al. | 160/133 X |
| 2,583,878 | 1/1952 | Plym | 160/235 |
| 2,812,813 | 11/1957 | Zarnowski | 160/235 |
| 4,173,247 | 11/1979 | Piana | 160/236 |
| 4,343,340 | 8/1982 | Paule | 160/236 X |
| 4,428,218 | 1/1984 | LaRocca | 160/235 X |
| 4,470,444 | 9/1984 | Riexinger et al. | 160/235 |
| 4,601,953 | 7/1986 | Haffer | 160/236 X |
| 4,723,588 | 2/1988 | Ruppel | 160/236 |

*Primary Examiner*—David M. Purol

*Attorney, Agent, or Firm*—Harness, Dickey & Pierce

[57] ABSTRACT

A roll-up, horizontally elongated, slat-type blind is formed of elongated slats which are hingedly connected together along their longitudinal edges. The slats are formed with upper flanges that are bent into downwardly opening flange hooks which extend into channels formed on the lower edges of the next adjacent slats. Each channel has an upwardly opening hook formed on one wall of the channel, and an opposite wall portion adjacent the hook. The flange hooks are notched at their opposite ends and the portions of the channel wall which overlap the notches are bent into tabs which extend inwardly to close the channel and to engage the opposite ends of the notches of the hook portions. Thus, the flange hooks are precluded from shifting endwise by the tabs to, thereby, maintain the slats in alignment at all times.

1 Claim, 1 Drawing Sheet

SYSTEM FOR MAINTAINING ALIGNMENT OF ROLL-UP BLIND SLATS

This is a continuation of U.S. patent application Ser. No. 922,868, filed Jul. 31, 1992 now abandoned.

BACKGROUND OF THE INVENTION

Horizontal slat-type, roll-up blinds, are conventionally formed of numerous, substantially identical, elongated slats which are arranged one above another and which are hingedly connected together along their adjacent edges. In this type of blind, the upper, elongated edges of each slat may be provided with an elongated flange which is bent into a downwardly opening hook. The lower ends of each of the slats are formed as channels with one wall of each channel being bent upwardly to form an upwardly opening hook. Thus, the hook flange of the upper edge of one slat is engaged within the channel in engagement with the hook formation of the channel.

With this type of construction, the slats are hingedly connected together and may be rolled up or down as desired. However, in this type of flange, there is a problem in maintaining the alignment of the slats relative to each other. That is, the slats tend to shift sideways during periods of use and therefor, a mechanism is needed to maintain the alignment of the slats.

Various types of devices have been used to try to maintain the alignment of the slats, such as brackets, fittings, etc. However, the conventional techniques for maintaining the alignments of the slats is relatively ineffective and somewhat expensive.

Thus, it would be desirable to provide some simplified way of maintaining the inter-connected slats in alignment by using the slates themselves without additional fasteners or brackets or the like in order to simplify the construction and reduce the costs. This invention relates to such a system for interlocking the slats in such a way that they do not shift sideways relative to each other.

SUMMARY OF THE INVENTION

This invention contemplates a system for preventing the horizontally arranged, longitudinally elongated, horizontal slats of a roll-up blind from shifting sideways relative to each other during the times that the blind is rolled up or down. In such type blinds, the slats are typically formed of either extruded or bent sheet metal profiles of uniform cross-section. Typically the upper edge of each slat is provided with an upwardly extending flange which is bent downwardly to form a flange hook. The flange hook is placed within the lower edge of a downwardly opening channel formed in the lower edge of the next adjacent slat. An internal, hook-like formation is bent on one of the edges of the channel for engaging with the flange hook inserted in the channel.

To prevent sidewise shifting of the slats, the opposite ends of each of the flange hooks is notched. Thus, the flanges terminate a short distance away from the free opposite ends of the slat. Next, a tab is formed on the wall defining the channel which is opposite the internal hook formed in the channel. The tab overlaps the adjacent notch. By bending the preformed tab, the channel opening is closed in the area of the flange notch of the next slat and the bent tab will engage the end of the flange to preclude endwise shifting of the flange hook within the channel within which it is located. Thus, a simple, inexpensive method is provided for preventing sideways shifting of the slats and for maintaining them in required alignment.

An object of this invention is to provide a simple, inexpensive method for maintaining the alignment of the inter-engaged slats by simply cutting away opposite end portions of the flange hooks of each slat and bending tabs at the opposite ends of the channels within which the flange hooks fit. Thus, labor and manufacturing expense is substantially reduced.

Another object of this invention is to provide a simple, inexpensive system for assembling and maintaining the horizontal slats of a roll-up blind in predetermined alignment and eliminating the need for additional fasteners or other devices to maintain such alignment.

Still another object of this invention is to provide a simple system for interlocking the adjacent edges of the horizontal slats which make up a roll-up type of blind to prevent unwanted disassembly or shifting of the parts relative to each other.

These and other objects and advantages of this invention will become apparent upon reading the following description, of which the attached drawings form a part.

DETAILED DESCRIPTION

Figure 1:
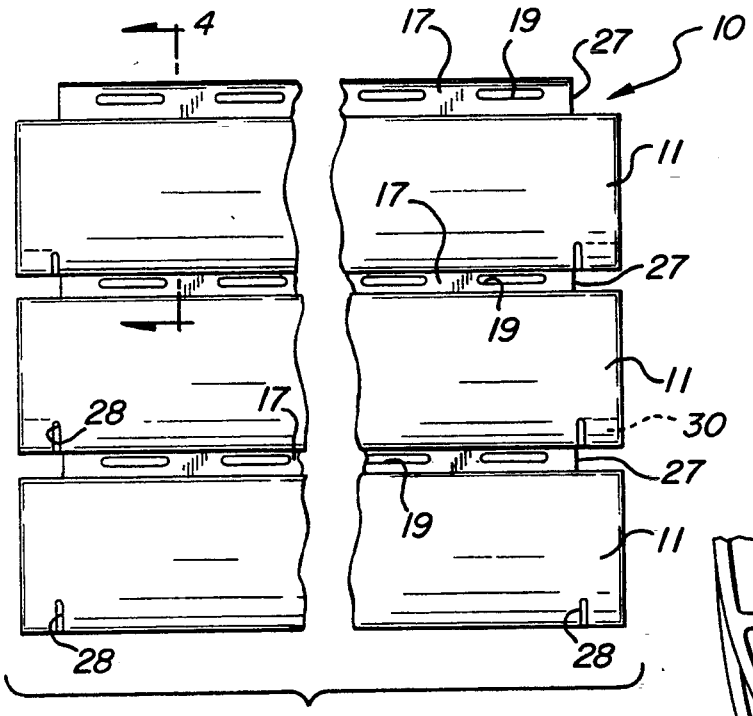
FIG. 1 is a schematic, fragmentary view of a portion of a conventional roll-up, horizontal slat-type, blind which has been modified in accordance with the invention herein.
Figure 2:
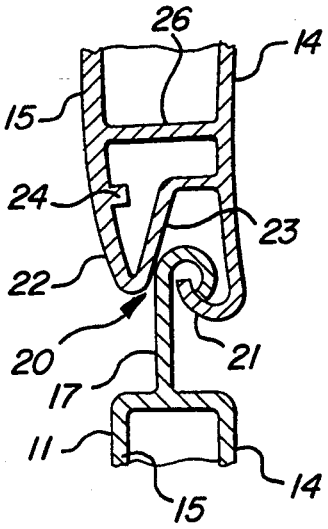
FIG. 2 is an enlarged, fragmentary cross-sectional view, of adjacent, interconnected edges of an upper and lower slat.

Referring to the drawings, FIG. 1 illustrates a roll-up, horizontal slat-type blind 10 which is made of a large number of substantially identical slats 11. The slats in 1–5, are illustrated as being formed of extrusions. These extrusions may be made of aluminum or of a suitable plastic material in a conventional manner.

Each extruded slat is formed within an inner wall 14 and an outer wall 15. The upper end of each slat is provided with an integral, upwardly extending flange 17, whose free edge is bent downwardly to form a flange hook 18. In addition, openings or ventholes 19 are formed in the flanges 17 to permit air to circulate through the blind when the blind is in an opening covering position.

The lower edge of each slat is provided with a continuous channel 20. The lower edge of one of the wall portions which define the channel is bent inwardly and upwardly within the channel to form an upwardly opening, continuous hook 21. The opposite lower end wall portion 22 of the opposite wall 15 defining the channel is provided with an inner integral strip or cover portion 23. Also, a continuous projection 24 is formed on the interior surface of the wall portion 22.

Figure 4:
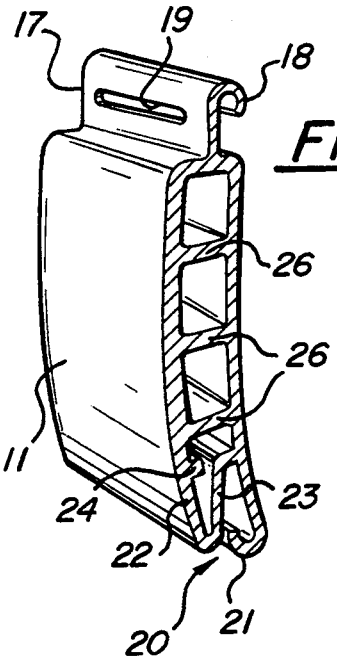
FIG. 4 is an enlarged, cross-sectional perspective view of a portion of a single slat and illustrates the upper flange hook and lower channel portions thereof.
Figure 5:
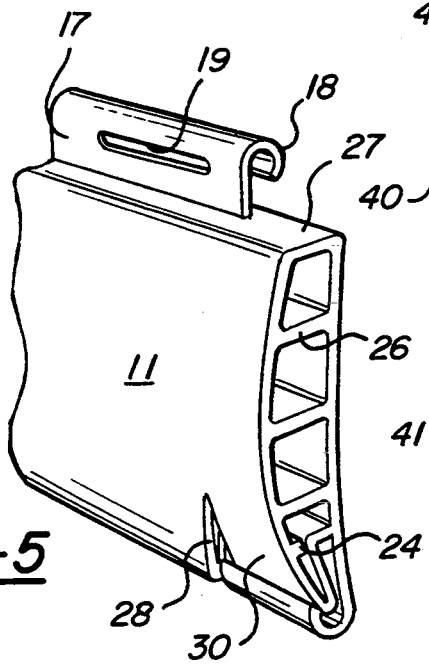
FIG. 5 is a fragmentary, perspective view showing the end portion of one of the slats with the tab bent into position for closing the end of the channel.

Since the slat is hollow, that is, it is formed of a pair of substantially parallel walls which are spaced apart, it is desired to rigidify the slat to prevent unwanted bending or flexing. Thus, the slat extrusions may be provided with integral cross-bars 26 as illustrated in FIGS. 4 and 5. Alternatively, the interior, space between the walls, may be filled with a suitable, rigid foam plastic material to rigidify the interior of the slats. However, the wall thicknesses of slats may be made sufficient to prevent the bending of the slats. In that case, the cross-bars or rigidifying foam plastic filling may be eliminated.

Figure 3:
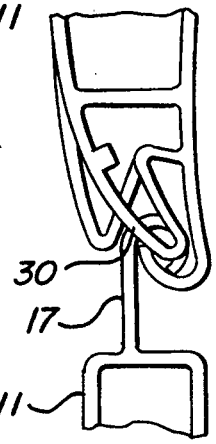
FIG. 3 is a cross-sectional view similar to FIG. 2, but showing an end view of the interengaged slats with the bent tab in position to prevent endwise shifting of the interconnected hook-like portions.

Notches 27 are cut into the flange hook at the opposite ends of each slat. At the lower edges of each slat, transverse slits 28 are formed in alignment with the ends of the notches 27. The wall portions between the slits 28 and the adjacent ends of the slats form bendable tabs 30. The tabs are bent inwardly, that is, into the channel to block the channel, as illustrated in FIGS. 3 and 5. Thus, when the flange hooks 18 are engaged within the channels, over the upwardly extending hooks 21 of the channels, they are prevented from sliding endwise by the tabs 30 which block the channels and enter the notches 27.

Figure 6:
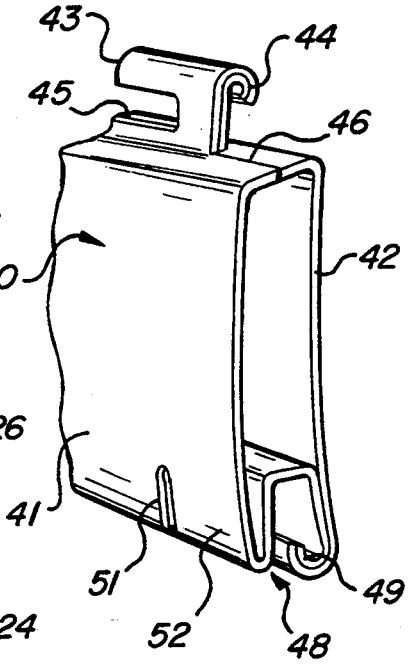
FIG. 6 is a modified slat formed of bent sheet metal.

FIG. 6 shows a modified slat 40 which is made of bent sheet metal strips. The sheet metal slat is formed with parallel sheet metal walls 41 and 42 which are joined together at their upper edges to form the upper flange 43. The free edge of the upper flange is bent downwardly to form the flange hook 44. Vent openings 45 are formed in the flanges and the opposite ends of the flanges are provided with notches 46.

The flange hook 44 is extended into the channel 48 formed along the lower edge of the slat and engages over the hook 49 which is bent from one longitudinal edge of the wall portion defining the channel in the next higher slat. A slit 51 is formed near each of the opposite ends of the channel. Thus, after the flange hooks are inserted endwise into the channels, they are held from sidewise movement within the channels by the bent tabs 52.

Individual slats may be preformed, whether of the extruded-type or the bent sheet metal-type, with the flange hook notches and the slits in the channeled edges. Then the slats can be assembled together, by endwise sliding the flange hook of one slat into the channel of the next one. Then, the tab, located at each end of the slat, is bent into the notch of the hook portion received within that channel. Hence, assembly of the blind and provision of the means for preventing shifting of the slats involves minimal labor and no additional fasteners or devices.

This invention may be further developed within the scope of the following claims. Accordingly, it is desired that the foregoing description be read as being merely illustrative of an operative embodiment of this invention and not in a strictly limiting sense. Having fully described at least one operative embodiment of this invention, I now claim:

1. In a horizontal slat-type, roll-up, blind formed of numerous, substantially identical, elongated slats which are normally arranged one above another and are hingedly connected together along their adjacent longitudinal edges, with said slats each being formed of a pair of substantially parallel, spaced apart walls which are secured together to provide upper and lower longitudinal edges; with the upper edge of each slat formed with an integral, elongated flange having an upper free edge bent into a downward opening hook and with the lower edge of each slat formed as a downwardly opening channel defined by opposite, lower portions of the two walls, and with the lower edge of one of the two walls being bent into the channel and upwardly to form an upwardly opening hook within the channel, and with the lower edge of the opposite wall portion forming the channel extending along side of the upwardly opening hook and spaced a short distance therefrom, and with the hook on the upper free edge of one slat extending into the channel and pivotally engaged with the upwardly opening hook on the adjacent lower edge of the next slat, the improvement comprising:

said slat walls each being completely formed of thin sheet metal pieces which are bent and joined together to form the slats;

a notch formed at opposite ends of the flange hook, by removing a short length of the flange hook at the opposite ends of each slat, and with the flange hook extending along the length of the slat between the notches;

a cover portion integrally formed with said opposite wall portion such that a curve having an overall V-shape, when viewed in cross section, is formed at the free end of said opposite wall between said opposite wall portion and cover portion and said cover portion abutting said flange hook when said blind is in a hanging position;

a continuous projection formed on said opposite wall portion and extending toward said cover portion within said V;

horizontally elongated openings formed in each of the flanges between their free ends and the upper edges of the walls for providing for ventilation through the slats when the blind is arranged to cover an opening such as a window or door opening;

a transverse slot formed in end portions of the areas of said opposite wall portion which overlaps the notches at the opposite ends of the flange hook, a tab formed at the end portions only on said opposite wall portion, said tabs being inwardly bent to extend inwardly of the channel towards the upwardly opening hook for substantially closing the channel at the opposite ends thereof and whereby said projection is adjacent said cover portion on said tab;

said slats being formed of continuous type elongated extrusions which are cut to predetermined slat length and, are of uniform cross section along their lengths, and with the notches being cut in the opposite ends of the flange hook of each slat, with slits arranged transversely in the slats along their opposite wall portion in alignment with the notches and with the tabs being bent at the slits;

whereby the tabs are engageable with the opposite ends of the flange hook to prevent the flange hook from moving endwise relative to the channels within which they are inserted and to thereby prevent the slats from shifting endwise relative to each other.

* * * * *